US006848122B1

(12) United States Patent
Meeds

(10) Patent No.: US 6,848,122 B1
(45) Date of Patent: Feb. 1, 2005

(54) DECORATIVE REMOVABLE HELMET COVER FOR SKI, SHOWBOARD, SKATEBOARD AND VARIOUS TYPES OF HELMETS

(76) Inventor: Joe Meeds, 15673 W. 72$^{nd}$ Cir., Arvada, CO (US) 80007

( * ) Notice: Subject to any disclaimer, the term of this patent is extended or adjusted under 35 U.S.C. 154(b) by 0 days.

(21) Appl. No.: 10/754,384

(22) Filed: Jan. 12, 2004

(51) Int. Cl.$^{7}$ ..... A42B 1/24
(52) U.S. Cl. ..... 2/422; 2/175.6
(58) Field of Search ..... 2/422, 424, 425, 2/410, 411, 171.1, 175.6

(56) References Cited

U.S. PATENT DOCUMENTS

| | | | | | |
|---|---|---|---|---|---|
| 1,368,864 | A | * | 2/1921 | Turner | 2/175.6 |
| 2,880,422 | A | * | 4/1959 | Blauer | 2/175.6 |
| 3,155,981 | A | * | 11/1964 | McKissick et al. | 2/422 |
| 6,061,836 | A | * | 5/2000 | Peters | 2/175.6 |
| 6,256,799 | B1 | * | 7/2001 | McGlasson et al. | 2/422 |
| 6,711,752 | B2 | * | 3/2004 | Smith | 2/422 |
| 2001/0004773 | A1 | * | 6/2001 | Moore | 2/425 |

FOREIGN PATENT DOCUMENTS

| | | | | |
|---|---|---|---|---|
| JP | 11323647 A | * | 11/1999 | A42B/3/04 |
| JP | 2003342822 A | * | 12/2003 | A42B/3/04 |

* cited by examiner

*Primary Examiner*—Rodney M. Lindsey
(74) *Attorney, Agent, or Firm*—Edwin H. Crabtree; Ramon L. Pizarro; Donald W. Margolis

(57) ABSTRACT

A decorative removable helmet cover adapted for receipt over the top of a hard plastic exterior surface of a ski helmet, a snowboard helmet, a skateboard helmet, a bicycle helmet or hardhat for providing a unique appearance to the helmet or the hardhat. The removable helmet cover includes a flexible dome-shaped soft cloth exterior surface disposed on top of a flexible dome-shaped soft cloth interior liner. The interior liner is adapted for receipt over and conform to an exterior surface of the helmet. A lower circumference of the exterior surface is attached to a hollow elastic band. Also, a lower circumference of the interior liner is attached to the hollow elastic band. Disposed inside the hollow elastic band is an elastic tie. Opposite ends of the tie extend outwardly from an opening in a rear portion of the elastic band. The opposite ends of the tie are received through a tie lock and are attached to a tie pull. The tip pull and tie lock are used for pulling on the tie and tightening it around sides of the helmet.

10 Claims, 2 Drawing Sheets

DECORATIVE REMOVABLE HELMET COVER FOR SKI, SHOWBOARD, SKATEBOARD AND VARIOUS TYPES OF HELMETS

BACKGROUND OF THE INVENTION (a) Field of the Invention

This invention relates to a cover for hard plastic helmets and hardhats and more particularly, but not by way of limitation, to a dome-shaped decorative helmet cover adapted for removable attachment to a ski helmet, a snowboard helmet, a skateboard helmet and other types of helmets. The helmet cover can provide a variety of unique designs, emblems, logos, school and team colors to an exterior appearance of the helmet.

(b) Discussion of Prior Art

In U.S. Pat. No. 6,101,636 to Williams, a motorcycle helmet with a three-dimensional sculpture is illustrated. The sculpture is permanently attached to an outer surface of the helmet. In U.S. Pat. No. 5,781,934 to Pauley, Jr., a sports cap kit is described having a primary sports team symbol with an open mouth and a moveable jaw. A secondary sports team symbol is received inside the open mouth of the primary symbol for depicting the "chewing up" of an opposing team. In U.S. Pat. No. 6,279,167 to Johnson et al., a cap is disclosed with a plush animal attached thereto. The plush animal includes a strip of cloth having button holes for attaching the animal to the top of the cap. In U.S. Pat. No. 6,000,063 to Sullivan, a sports hat is illustrated with a three-dimensional sport team insignias. The sport team insignia is made of flexible foam and is attached to a crown of the sports hat.

None of the above mentioned prior art patents specifically disclose the unique features, structure and function of the subject decorative helmet cover.

SUMMARY OF THE INVENTION

In view of the foregoing, it is a primary objective of the subject invention to provide a dome-shaped removable helmet cover adapted for releasable attachment to an exterior surface of a hard plastic helmet or hardhat Another object of the helmet cover is to provide a flexible dome-shaped soft cloth exterior surface and a flexible dome-shaped soft cloth interior liner, which is adapted to stretch over and conform to the exterior surface of the helmet. The helmet cover is designed, because of its flexibility and elasticity, to fit various sizes of helmets using a single cover.

Yet another object of the helmet cover is to provide a decorative object or objects attached to and extending outwardly from the exterior surface of the helmet cover.

Still another object of the helmet cover is it can be used for receipt over a ski helmet, snowboard helmet, skateboard helmet, bicycle helmet and a variety of other types of helmets and hardhats worn for head protection.

The removable helmet cover includes a flexible dome-shaped soft cloth exterior surface disposed on top of a flexible dome-shaped soft cloth interior liner. The interior liner is adapted for receipt over and conform to an exterior surface of a hard plastic helmet. A lower circumference of the exterior surface is attached to a hollow elastic band. Also, a lower circumference of the interior liner is attached to the hollow elastic band. Disposed inside the hollow elastic band is an elastic tie. Opposite ends of the tie extend outwardly from an opening in a rear portion of the elastic band. The opposite ends of the tie are received through a tie lock and are attached to a tie pull. The tip pull and tie lock are used for pulling on the tie and tightening it around sides of the helmet.

These and other objects of the present invention will become apparent to those familiar with various types helmet covers when reviewing the following detailed description, showing novel construction, combination, and elements as herein described, and more particularly defined by the claims, it being understood that changes in the various embodiments of invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the principles thereof, and in which.

DETAILED DESCRIPTION OF THE PREFERRED EMBODIMENTS

Figure 1:
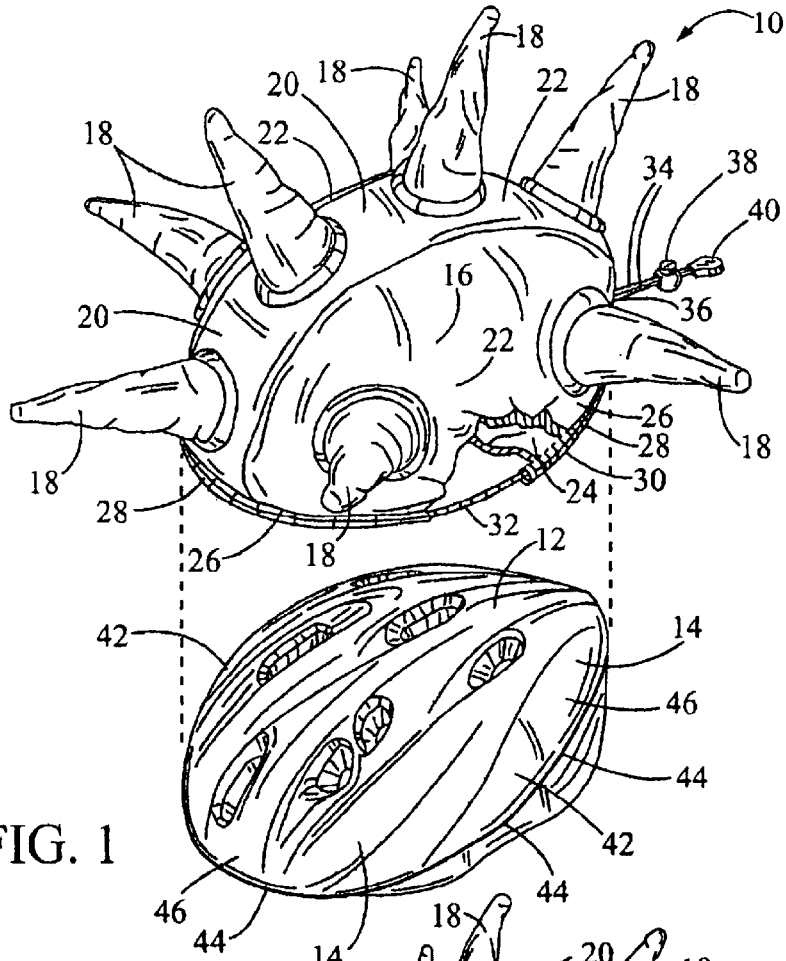
FIG. 1 is a perspective view of the dome-shaped decorative removable helmet cover positioned above a hard plastic helmet. An exterior surface of the helmet cover includes a plurality of inverted cones attached thereto for depicting a court jesters hat.

In FIG. 1, a perspective view of the dome-shaped decorative removable helmet cover is shown having general reference numeral 10. The helmet cover 10 is positioned above a hard plastic exterior surface 12 of a helmet 14. The helmet 14 can be a ski or snowboard helmet, a bicycle helmet, a skateboard helmet and other types of helmets and hardhats used for head protection for head protection used during outdoor and indoor activities.

In this drawing, the flexible dome-shaped soft cloth exterior surface 16 of the helmet cover 10 is shown having a plurality of inverted cones 18 attached thereto. The inverted cones 18 help depict a court jesters hat. Also, the exterior surface 16 includes a stripe 20 on one color down the middle of the exterior surface 16 with side portions 22 on the opposite sides of the stripe 20 having a different color for added design and flare. Obviously, the exterior surface can have any number of color combinations and designs for showing school, team and organization colors and trade dress.

The flexible dome-shaped soft cloth exterior surface 16 is disposed on top of a flexible dome-shaped soft cloth interior liner 24. The interior liner 24 is adapted for receipt over and conform to different contours of the hard plastic exterior surface 12 of the helmet 14. A lower circumference 26 of the exterior surface 16 is attached to a hollow elastic band 28. Also, a lower circumference 30 of the interior liner 24 is attached to the hollow elastic band 28. Disposed inside the hollow elastic band 28 and therearound is an elastic tie 32. Opposite ends 34 of the tie 32 extend outwardly from an opening 36 in a rear portion of the elastic band 28. The opposite ends 34 of the tie 32 are received through a tie lock 38 and are attached to a tie pull 40. The tie pull 40 and tie lock 38 are used for pulling on the tie 32 and tightening the band 28 around opposite sides 42 of the helmet 14. Because the exterior surface 16 and the interior liner 24 are flexible with the elastic band 28, the helmet cover 10 fits various sizes of helmets and hardhats using a single helmet cover.

Figure 2:
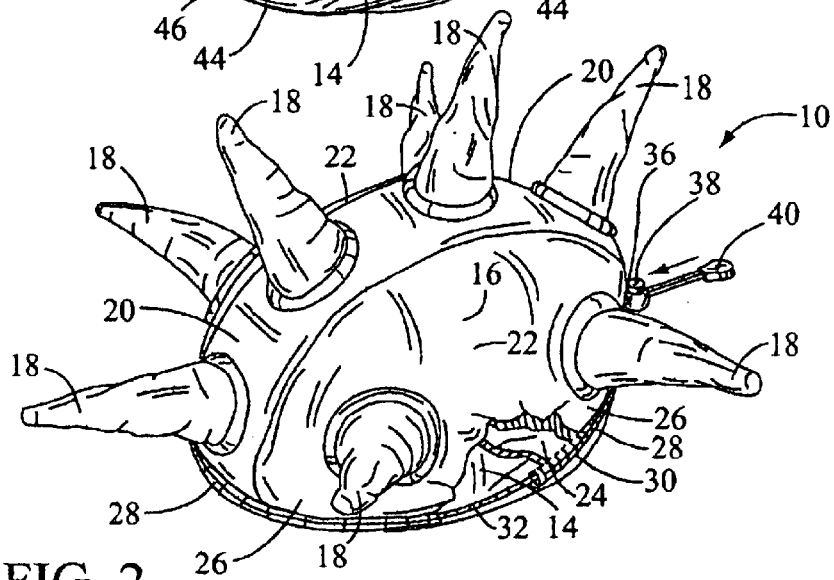
FIG. 2 is a perspective view of the helmet cover shown in FIG. 1 received on top of the hard plastic helmet and secured around the lower sides of the helmet.

In FIG. 2, a perspective view of the helmet cover 10 is shown received over the top of the hard plastic exterior surface 12 of the helmet 14. In operation, when securing the helmet cover 10 to the helmet 14, the hollow elastic band 28 is received around and placed below a helmet lip 44 around a lower portion 46 of the helmet 14. The helmet lip 44 is typical found on modern day snowboard, ski, skateboard and bicycle helmets. The band 28 is then tightened under the helmet lip 44 by pulling the tie pull 40 outwardly and the tie lock 38 inwardly toward and next to the opening 36 in the band 28 as shown in this drawing. In this mariner, the elastic band 28 prevents the helmet cover 10 from coming off the hard plastic exterior surface 12 of the helmet 14. Obviously, by loosening the tie lock 38 and moving it outwardly on the tie 32, as shown in FIG. 1, the band 28 can be quickly loosened from around the lower portion 46 of the helmet 14.

Figure 3:
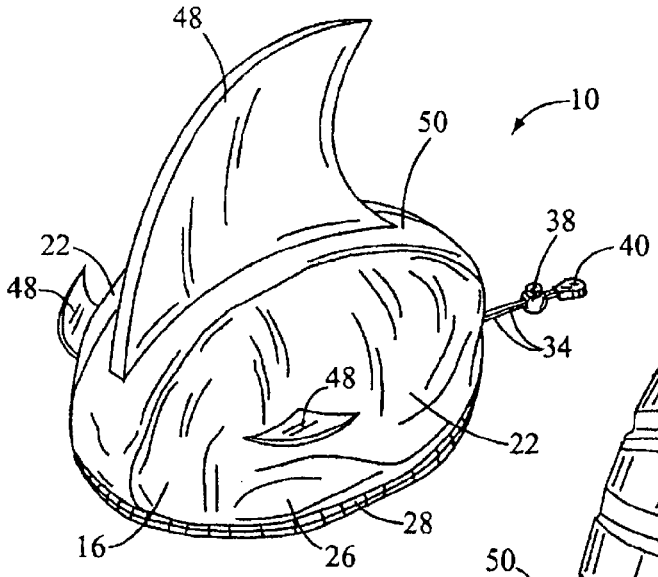
FIG. 3 is a perspective view of the helmet cover having shark fins attached to the exterior surface.

In FIG. 3, a perspective view of a different embodiment of the helmet cover 10 is shown. In this example, the helmet cover 10 includes shark fins 48 attached to a top 50 and side portions 22 of the soft cloth exterior surface 16 of the helmet cover 10.

Figure 4:
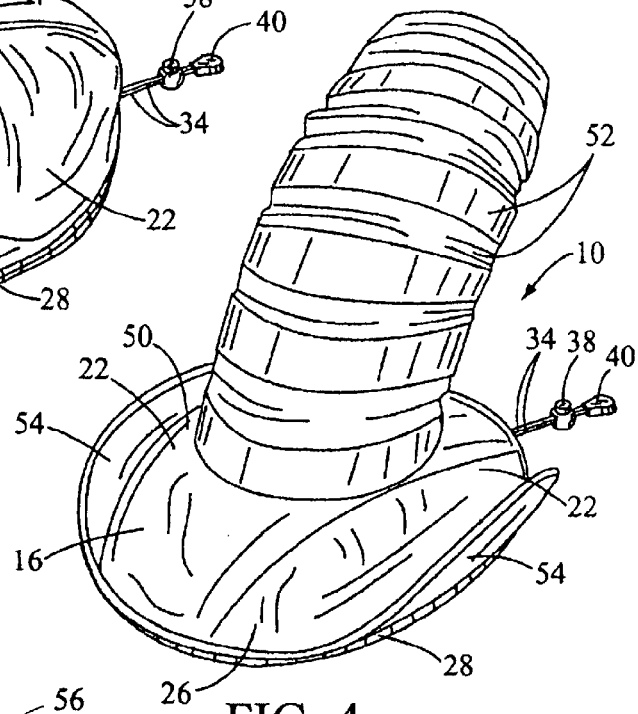
FIG. 4 is another perspective view of the helmet cover having an upwardly extending tall stripped hat with band brim attached to the exterior surface.

In FIG. 4, another perspective view of still another embodiment of the helmet cover 10 is shown. In this example, the helmet cover 10 includes a striped top hat 52 with hat brim 54 attached the top 50 and side portions 22 of the exterior surface 16 of the helmet cover.

Figure 5:
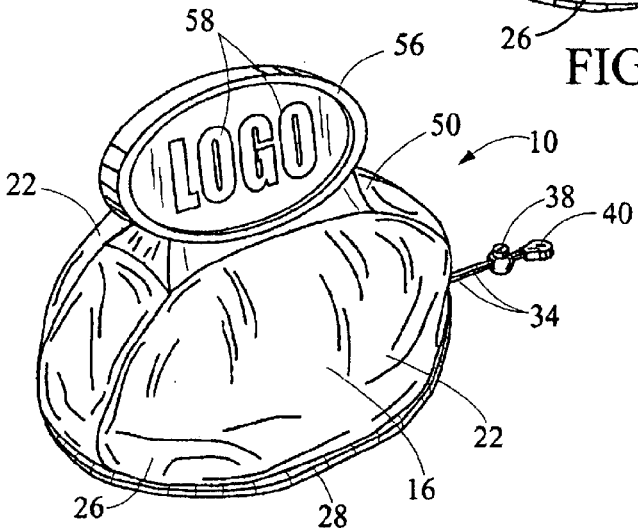
FIG. 5 is still another perspective view of the helmet cover having an upwardly extending hat frame with logo attached to the exterior surface.

In FIG. 5, another perspective view of yet another embodiment of the helmet cover 10 is shown. In this example, the helmet cover 10 includes a logo frame 56 with logo 58 thereon and attached to the top 50 of the exterior surface 16 of the helmet cover 10. Obviously, from reviewing the above discussed drawings, the helmet cover is readily adaptable to various types of designs and objects attached thereto for adding a different look to a helmet or hardhat.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which as exclusive privilege and property right is claimed are defined as follows:

1. A decorative removable helmet cover adapted for receipt over the top of a hard plastic exterior surface of a helmet for providing a unique appearance to the helmet, the helmet cover comprising:

a flexible dome-shaped soft cloth exterior surface;

a flexible dome-shaped soft cloth interior liner received inside said cloth exterior surface and attached thereto, said interior liner adapted for receipt over a contour of the exterior surface of the helmet; and attachment means attached to said cloth exterior surface and said interior liner, said attachment means for securing the helmet cover to the exterior surface of the helmet.

2. The helmet cover as described in claim 1 wherein said attachment means is a hollow band with a tie received therein, said hollow band attached to a lower circumference of said exterior surface and attached to a lower circumference of said interior liner.

3. The helmet cover as described in claim 2 further including a tie lock and a tie pull attached to opposite ends of said tie, said tie lock for securing said tie inside said hollow band.

4. The helmet cover as described in claim 1 wherein said cloth exterior surface includes at least one decorative object attached to and extending outwardly therefrom.

5. A decorative removable helmet cover adapted for receipt over the top of a hard plastic exterior surface of a helmet or hardhat for providing a unique appearance to the helmet, the helmet cover comprising:

a flexible dome-shaped soft cloth exterior surface having a decorative object extending outwardly therefrom;

a flexible dome-shaped soft cloth interior liner received inside said cloth exterior surface and attached thereto, said interior liner adapted for receipt over a contour of the exterior surface of the helmet;

a hollow elastic band attached to a lower circumference of said cloth exterior liner and attached to a lower circumference of said interior liner, and an elastic tie received inside said hollow elastic band, whereby when said tie is tightened inside said hollow elastic band said hollow elastic band is secured to opposite sides of the helmet.

6. The helmet cover as described in claim 5 wherein opposite ends of said tie extend outwardly from an opening in said hollow elastic band, said opposite ends received through a tie lock and attached to a tie pull, said tie lock for securing said tie inside said hollow band.

7. The helmet cover as described in claim 5 wherein said cloth exterior surface includes a plurality of decorative objects attached to and extending outwardly therefrom.

8. A decorative removable helmet cover adapted for receipt over the top of a hard plastic exterior surface of a helmet or hardhat for providing a unique appearance to the helmet, the helmet cover comprising:

a flexible dome-shaped soft cloth exterior surface having a decorative object attached thereto and extending outwardly therefrom;

a flexible dome-shaped soft cloth interior liner received inside said cloth exterior surface and attached thereto, said interior liner adapted for receipt over a contour of the exterior surface of the helmet;

a hollow elastic band attached to a lower circumference of said cloth exterior liner and attached to a lower circumference of said interior liner; said hollow elastic band having an opening therein; and an elastic tie received inside said hollow elastic band, said elastic tie having opposite ends extending outwardly from said opening in said hollow elastic band, said opposite ends received through a tie lock and attached to a tie pull, said tie lock for securing said tie inside said hollow elastic band and adapted for tightening said hollow elastic band around opposite sides of the helmet.

9. The helmet cover as described in claim 8 wherein said cloth exterior surface includes a plurality of decorative objects attached to and extending outwardly therefrom.

10. The helmet cover as described in claim 8 wherein said cloth exterior surface and said interior liner are sufficiently flexible for receipt over the exterior surface of different size helmets.

* * * * *